US005769337A

United States Patent [19]

Gobbin

[11] Patent Number: 5,769,337

[45] Date of Patent: Jun. 23, 1998

[54] WASTE CONTAINER MADE OF SYNTHETIC MATERIAL WITH MEANS OF REDUCING THE VOLUME OF SAID WASTE

[75] Inventor: Belindia Gobbin, Dino, Switzerland

[73] Assignee: Abilfida (Chiasso) S.A., Chiasso, Switzerland

[21] Appl. No.: 783,234

[22] Filed: Jan. 14, 1997

[51] Int. Cl.[6] ..... B02C 15/12

[52] U.S. Cl. ..... 241/36; 241/100; 241/152.2

[58] Field of Search ..... 241/36, 100, 152.2, 241/160, 162, DIG. 38

[56] References Cited

U.S. PATENT DOCUMENTS

| | | | |
|---|---|---|---|
| 3,053,297 | 9/1962 | Brundler | 241/162 |
| 5,046,669 | 9/1991 | Wallace et al. . | |
| 5,292,193 | 3/1994 | Funk | 241/162 |

FOREIGN PATENT DOCUMENTS

| | | | |
|---|---|---|---|
| 0146820 | 7/1985 | European Pat. Off. | 241/160 |
| 0 411 438 | 2/1991 | European Pat. Off. . | |
| 23 63 708 | 11/1975 | Germany . | |
| 33 13 517 | 10/1983 | Germany . | |
| 223079 | 6/1985 | Germany | 241/160 |
| 37 23 038 | 1/1989 | Germany . | |
| 648 512 | 3/1985 | Switzerland . | |
| 1196024 | 12/1985 | U.S.S.R. | 241/160 |

*Primary Examiner*—Mark Rosenbaum
*Attorney, Agent, or Firm*—Young & Thompson

[57] ABSTRACT

In a synthetic-material container (1) for special waste (2) which has elements of reducing the volume of the waste by shredding, which elements consist of a number of rotating cutting elements that force the waste against stationary cutters, these elements are composed of one or more rotating horizontal cutting elements (3) which are mated with stationary horizontal cutters (4), as well as at least one pair composed of vertical cutting elements (5) and of second stationary vertical cutting elements (6) that are arranged downstream from horizontal cutting elements (3) and above-mentioned horizontal cutting elements (4) and which act in such a way as to shred again waste (2) that is introduced into the container (1), further reducing its volume, whereby said the horizontal rotating cutting elements (3) are able, by their rotation, to create a certain overpressure toward the bottom of the container (1).

5 Claims, 2 Drawing Sheets

WASTE CONTAINER MADE OF SYNTHETIC MATERIAL WITH MEANS OF REDUCING THE VOLUME OF SAID WASTE

FIELD OF THE INVENTION

This invention pertains to the very important field of devices for the differentiated collection of waste, for the purpose of facilitating the work of destruction and disposal that is to be carried out at dumps and, where possible, to make it possible to recover the waste itself in order to recycle it.

BACKGROUND OF THE INVENTION

The deliberate differentiated collection of waste is now being done in the more advanced countries in order to recycle polyethylene teraphthalate (P.E.T.), which is used to make holders such as bottles, envelopes, etc.

This kind of waste is collected in suitable separate containers, some of which are already equipped with means of reducing the volume of the waste in order to make it possible to store more waste in containers whose dimensions are compatible with the operations of removal, transport, etc.

As far as the inventor is aware, such containers are currently equipped with several pairs of knives for vertical slicing that are mounted on counter-rotating horizontal shafts: the material to be shredded is manually inserted by the operator, who places it on the knives and activates it by means of a pair of simultaneous-action safety push-buttons, of the type that are used on, e.g., presses in order to keep the operator's hands or clothes from being accidentally snagged.

This kind of activation turns out not to be very easy, and this drawback is avoided by, among other things, using a container which is activated according to the invention and which operates fully automatically, as will be explained later. In addition to said drawback, the operation of the cutting knives and their structure necessarily give rise to a peripheral velocity of their rotation that is relatively limited owing to, on the one hand, the resultant extensive shredding and, on the other, to the need for the fragments of waste to pass between the knives several times until they are shredded to the extent desired.

In addition, a container of the conventional type as described above cannot operate "continuously," as is required in the case of, e.g., centers that collect large quantities of special waste, for example, supermarkets, hospitals, barracks, etc.

It is, in fact, necessary to load the container with a limited amount of waste that can be accommodated in the space that holds the knives; said waste is shredded, and then another cycle is started with another load of waste, another shredding operation is executed, and so forth.

The amount of waste that can be inserted per cycle is limited by the fact that, in order to be able to make use of an adequate space for accommodating a sufficient amount of shredded waste in the lower part of the container without having to raise said container to the point where it becomes necessary to use access stairs, the space that holds the knives is of limited depth.

SUMMARY OF THE INVENTION

The inventor of the container according to this invention has eliminated all of the drawbacks listed above by developing a container that is equipped with means that are able to accomplish very rapid shredding of the waste by means of two successive operations and by equipping the container itself with means that are capable of actuating the shredding means automatically, even in continuous operation, whereby the actuation is halted, also automatically, when all of the waste inserted into the container has been shredded to the desired extent.

These characteristics make it possible to place a container according to the invention on any stand or in any location that is used for the differentiated collection of waste, whereby no effort is required except for the simple introduction of the waste itself.

Such a container can therefore be used in any public or private location such as supermarkets, hospitals, barracks, or private dwellings, provided that its technical characteristics have been properly differentiated according to the intended use; said differentiation will be explained in more detail below.

More particularly, the object of this invention consists of a container for collecting special waste, whereby said container is made of synthetic material and is equipped with means that are able to reduce the volume of said waste; said means achieve said reduction in volume by shredding the waste itself. The means consist of a number of rotating cutting elements which are able to force the waste against the matching cutters, thereby slicing it, characterized by the fact that said means consist of one or more horizontal rotating cutting elements that are mated with horizontal matching stationary cutters, as well as at least one pair that is composed of vertical rotating cutting elements and matching stationary vertical cutters, whereby said pair is arranged downstream from the horizontal rotating cutting elements and the above-mentioned horizontal stationary cutters, which work in such a way as to shred again the waste that is introduced into the container, further reducing its volume to a predetermined extent; the horizontal rotating cutters are able to create, through their rotation, a certain overpressure in the direction of the bottom of the container.

BRIEF DESCRIPTION OF THE DRAWINGS

A more detailed description will now be given of some preferred embodiments of the invention, also referring to the attached drawings, where.

DETAILED DESCRIPTION OF THE INVENTION

Figure 1:
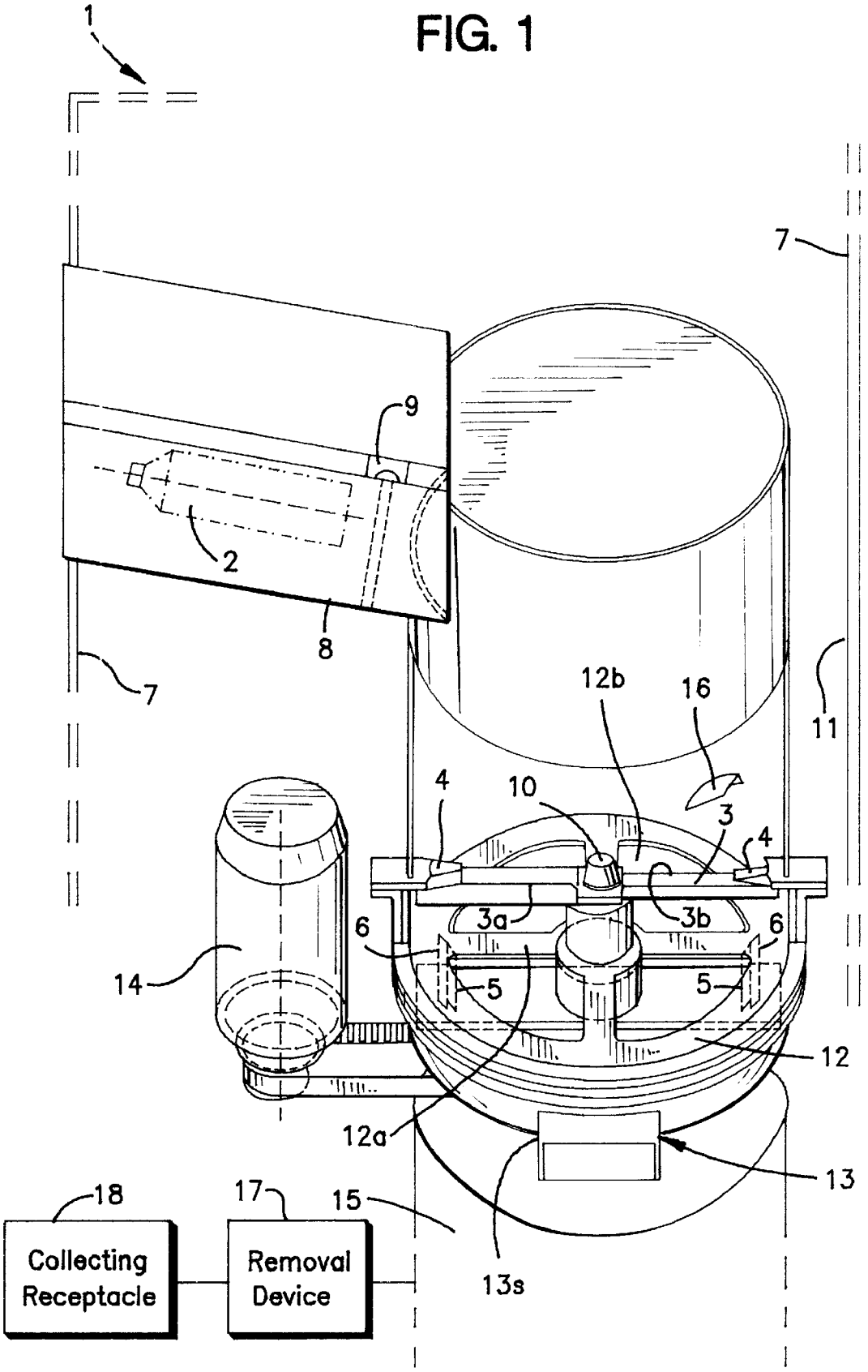
FIG. 1 shows a perspective cutaway view of an example of a container according to the invention with a built-in collector and the outer housing indicated only in outline.

Consider FIG. 1: in it container 1 according to the invention is depicted in an embodiment with a shredded-waste collecting device 15 built into it.

The embodiment, whose external shape and dimensions can obviously be designed as required, proves to be particularly well suited for use in small communities, e.g., condominiums or private dwellings, where the amount of waste to be disposed of is not large.

Figure 2:
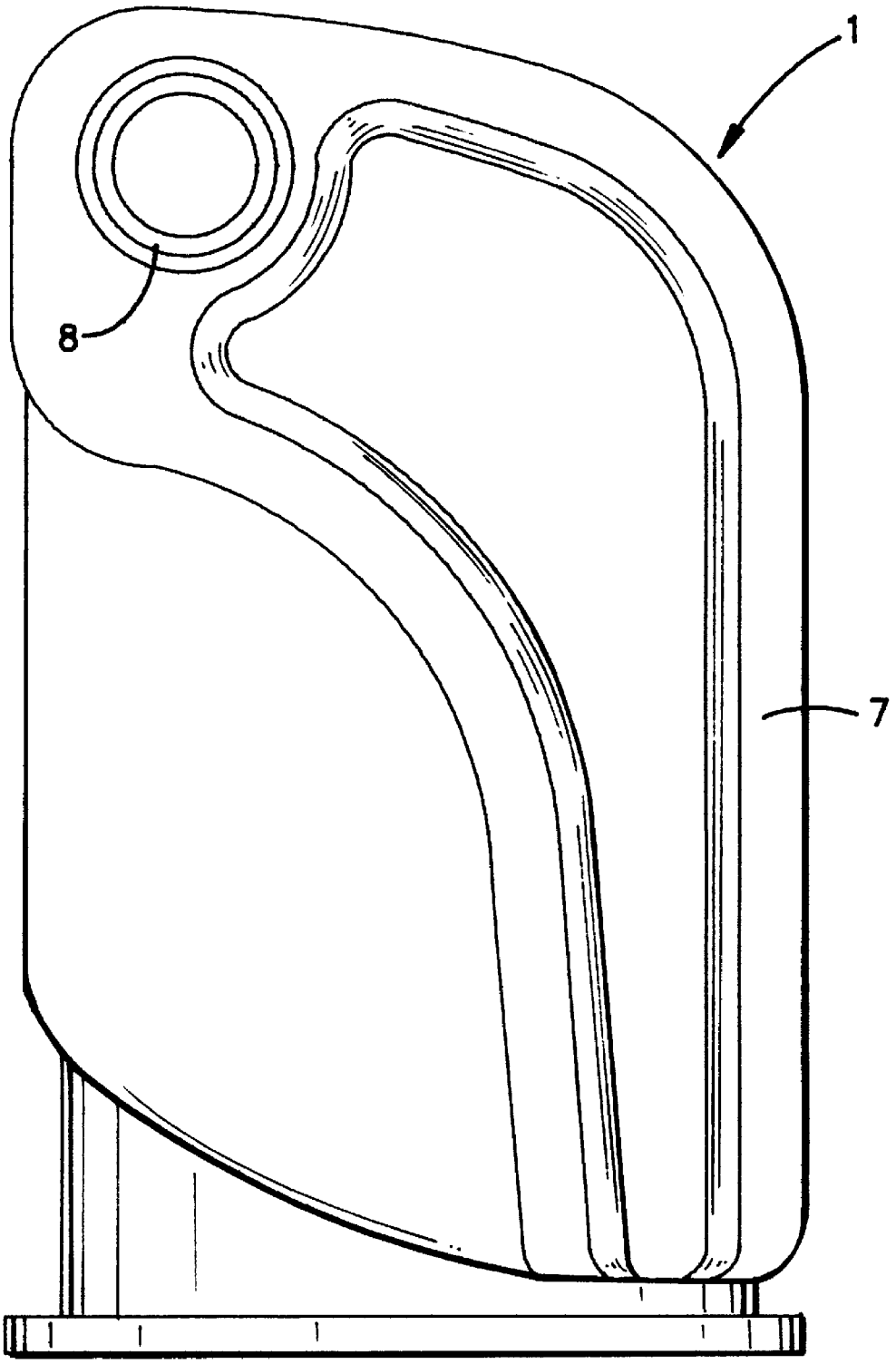
FIG. 2 shows a side view of the outside of the housing of the container.

Container 1, which is equipped with an outer housing 7 and is better depicted in FIG. 2, has an inlet tube 8 for waste 2, which tube preferably slopes downward and into which the waste to be shredded is introduced.

Inside said tube 8 are arranged means 9 (for example, a photocell or similar device) that are able to detect the presence of waste 2 inside tube 8 and therefore actuate one or more electric motors (14) that are able to drive the shredding devices, which will be explained in more detail below.

A stationary structure 11, which is closed on the sides and at the bottom and which may consist in part of housing 7 itself, support a vertical shaft 10, on which rests a horizontal blade 3 that is shaped like a propeller with one or more blades and is able, by its rotation, to create a certain overpressure in the axial direction toward the bottom of container 1. The propeller 3 has sharp cutting edges 3*a*, 3*b* which, as they rotate, face, grazing, a number of knives 4 that are attached to stationary structure 11 in parallel to blade 3 itself, whereby said knives are arranged corresponding to the areas of said sharp cutting edges 3*a*, 3*b* that are located radially further outward.

Below said blade 3 and said knives 4 is then arranged a wheel 12, which also rests on said vertical shaft 10 and which consists of a predetermined number of spokes 12a that are arranged between spaces 12*b* which have predetermined dimensions and are able to allow the fragments of trash to fall downward after they have reached a specified size.

To the area of wheel 12 that is located radially further outside are attached several vertical cutting elements 5, i.e., perpendicular to wheel 12 itself, and to said rigid structure 11 is secured a predetermined number of other cutters 6 which are parallel to the above-mentioned cutting elements and which are distributed circumferentially and are arranged in such a way that they are externally tangent to the trajectory that is described by the points of said cutting elements 5 that are further outside radially.

To said rigid structure 11 is attached or secured a discharge opening 13 which is located on a plane that is arranged below that of wheel 12 and which is preferably equipped with a slide-like extension 13s in order to direct the fragments of shredded waste in the desired direction.

Inside said rigid structure 11, close to said opening 13, and preferably in a position that is reached by the rotation of any point on said wheel just before reaching opening 13 itself, is secured at least one deflecting vane 16 which is of such a size, shape, and inclination that it can ensure that, under the action of the centrifugal force imposed on them by blade 3 and by wheel 12 as they rotate, the already shredded fragments of waste which reach it follow an essentially circular trajectory along the inside surface of structure 11 and are stopped and deflected to a predetermined extent in a desired direction that is oriented essentially toward vertical pin 10. The fragments, which are directed in this manner and which are almost completely drained of their kinetic energy in the direction of the circular motion, fall toward the bottom of stationary structure 11 close to discharge opening 13, from which they emerge under the action of the above-mentioned overpressure, which is created by the rotation of above-described propeller blade 3.

One or more electric motors 14 are then mechanically connected to said propeller blade 3 and to said wheel 12 in order to make it rotate when said motors are activated by photocell 9 when the waste is introduced, and container 1 is also equipped with a device (not shown), for example, a simple potentiometer, which is able to switch off the power to motors 14 when waste 2 has been completely shredded and removed, i.e., when the power drawn by the motor(s) to turn blade 3 and wheel 12 is reduced to a predetermined value, which corresponds to the unit's idling speed.

The operating sequence of a container that is designed according to the invention is thus the following:

Waste 2 is inserted into container 1 through inlet tube 8, whereby its passage activates electric motors 14 by means of photocell 9.

Waste 2 drops under the action of gravity until it enters the field of action of propeller blade 3, which spins at more than 2000–2500 rpm at a very high peripheral velocity and shreds it a first time by forcing it with its sharp cutting edges 3*a*, 3*b* against knives 4. Then the fragments of waste, which are already driven by a certain rotary motion around pin 10 under the action of the thrust exerted on them by blade 3, drop downward and come into contact with wheel 12 which, in addition to further reducing the volume of the waste by shredding it by means of vertical cutting elements 5 and stationary cutters 6, imparts to the waste another, even more powerful rotational force, which causes it to rotate inside rigid structure 11, describing a circular motion tangentially to structure 11 until the waste encounters deflecting vane 16, which is shaped and inclined in such a way as to select the fragments, whereby it alters the trajectory of the larger fragments only marginally and decelerates almost completely the small fragments which, being thereby deprived of their kinetic energy in the direction of the circular motion, rebound weakly in the direction of pin 10, i.e., inside container 1, and then fall downward close to discharge opening 13, from which they emerge under the action of the above-mentioned overpressure produced by propeller blade 3.

Clearly, said overpressure also helps, to a limited extent, to direct the waste and the fragments thereof from upstream in the downstream direction, i.e., from the top toward the bottom of the container.

From discharge opening 13, which is preferably equipped with an inclined chute 13*s*, the fragments of shredded waste drop into a collecting device 15 (a bag, a basket, etc.) which, like the rest of the container, is accommodated inside its outer housing 7.

In the case of a container according to the invention that is to be used in various communities and with a greater need for disposal in order, over time, to reduce the number of services that are needed to dispose of the shredded waste, the inventor has conceptualized a second type of embodiment of the container, which is not shown since it would be obvious to one skilled in the art.

All of the components are the same; only their sizes may vary, and the sequence of operation is identical.

The only difference consists of the fact that in this case container 1 is also equipped with a removal device 17 that is able to remove the fragments from collecting device 15, which has a suitably studied shape, and send the fragments into a large collecting receptacle 18 located close to the container itself.

The removal device may be, e.g., a motor-driven centrifugal turbine, a motor-driven volute with a catching tube, or other devices that are familiar to one skilled in the art.

It is obvious that the two preferred embodiments described heretofore and shown here do not exhaust all of the possible kinds of embodiments that can be achieved by a container according to the invention.

Various other embodiments that can be traced back to the concepts set forth in the attached claims would thus also fall within the framework of the protection conferred by this patent application.

With the aid of the container according to the invention, it is possible to achieve high disposal speeds (for this purpose the high peripheral cutting speed that can be obtained is highly valued) with fully automatic operation that is achieved with complete safety: it is impossible, for example, if the machine is properly sized, for clothes, hands, or limbs to reach the areas where the cutters operate. The goals that the inventor has set himself have thus been advantageously achieved.

I claim:

1. Container for collecting and shredding waste, comprising:

an outer housing;

an inlet tube for the waste to be shredded;

a horizontal blade shaped like a multi-blade propeller for creating a downward-directed axial overpressure, said blade being located downstream of the inlet tube for rotation around a vertical shaft, and having sharp cutting edges;

a stationary structure closed on its sides and bottom, and having a number of horizontal knives mounted thereon, said horizontal knives being arranged parallel to and at a predetermined distance from the blade, corresponding to areas of the sharp cutting edges that are radially further outward;

a horizontal wheel constructed and arranged for rotation around said shaft below the blade and having a number of cutting elements arranged perpendicular to the shaft;

a number of additional cutters that are parallel to the vertical cutting elements and are mounted on the stationary structure, each of said cutting elements being arranged to be externally tangent to a trajectory that is described by points of said cutting elements that are located radially further outward during rotation of the horizontal wheel, said wheel including a number of spokes arranged between an equal number of passing spaces which allow fragments of waste that are reduced to a predetermined volume to fall through;

a discharge opening facing outward and mounted on the stationary structure for allowing discharge of already-shredded waste under the combined action of the force of gravity and the overpressure that is created by the propeller blade;

at least one electric motor mechanically connected both to said wheel and to said blade for causing them to rotate when the motor is activated;

a first detecting device for detecting the presence of waste in the inlet tube and for activating the electric motor;

a collecting device for collecting and holding said waste after it has been shredded; and a second detecting device for detecting the electric power drawn by the blade and the wheel as they rotate, and for shutting off the power to the electric motor when power is reduced to a predetermined value.

2. Container according to claim 1, further comprising at least one deflecting vane mounted on the inner surface of said stationary structure close to said discharge opening, said deflecting vane being positioned, shaped, and dimensioned to decelerate and guide in a predetermined direction shredded waste having a certain size.

3. Container according to claim 2, further comprising a removal device constructed and arranged to take the shredded waste from said collecting device and direct it to a collecting receptacle located close to the container.

4. Container according to claim 3, wherein said removal device consists of a motor-driven centrifugal turbine adapted to catch the shredded waste.

5. Container according to claim 3 wherein said removal device consists of a motor-driven volute with a catching tube for the shredded waste.

* * * * *